US006607150B1

(12) United States Patent
Izutsu et al.

(10) Patent No.: US 6,607,150 B1
(45) Date of Patent: Aug. 19, 2003

(54) METHOD AND APPARATUS FOR CRUSHING MATERIAL

(75) Inventors: Tadao Izutsu, Hiroshima (JP); Junichi Ichikawa, Hiroshima (JP); Yuichi Nagahara, Hiroshima-ken (JP)

(73) Assignee: Kabushikikaisha Piste Snow Industries, Tokyo (JP)

( * ) Notice: Subject to any disclaimer, the term of this patent is extended or adjusted under 35 U.S.C. 154(b) by 189 days.

(21) Appl. No.: 09/686,377

(22) Filed: Oct. 11, 2000

(51) Int. Cl.[7] ..... B02C 25/00

(52) U.S. Cl. ..... 241/18; 241/27; 241/33; 241/34; 241/47; 241/65

(58) Field of Search ..... 241/17, 18, 27, 241/33, 47, 65, 34

(56) References Cited

U.S. PATENT DOCUMENTS 6,334,327 B1 * 1/2002 Fujiwara ..... 241/194

FOREIGN PATENT DOCUMENTS

| | | |
|---|---|---|
| JP | 4-35664 | 11/1992 |
| JP | 11-319608 | 11/1999 |
| JP | 2996949 | 1/2000 |

* cited by examiner

*Primary Examiner*—John M. Husar
(74) *Attorney, Agent, or Firm*—Omori & Yaguchi USA, LLC

(57) ABSTRACT

The disclosed method and apparatus for crushing material such as ice include a controller to actively control the speed, volume, temperature, and humidity of airflow to improve the crushing efficiency.

16 Claims, 3 Drawing Sheets

METHOD AND APPARATUS FOR CRUSHING MATERIAL

FIELD OF THE INVENTION

The current invention is generally related to forced-air type material crushing devices for crushing certain materials such as ice, rock, wood, plastic, glass and waste material, and more particularly related to an improvement in independently controlling certain aspects of the crushing devices.

RELATED PATENT APPLICATION

Japanese Patent 2996949 is related to the current application, and its filing date is Jun. 26, 1998. The above Japanese application was not published until Japanese Patent 2996949 was issued on Jan. 11, 2000. The current application includes the same disclosures of the corresponding Japanese application Hei 11-319608, which was filed on May 8, 1998 and was published on Nov. 24, 1999, but the current application is not based upon priority of this corresponding Japanese application.

BACKGROUND OF THE INVENTION

FIG. 1 illustrates one exemplary ice crushing device in the prior art. An inlet c and an outlet d form an angle of approximately 180 degrees, and the inlet c and the outlet d are attached to a housing a. Ice is supplied through the inlet c into the housing a where rotatable crushing blades b are housed. The blades b rotate in a clockwise direction, and pieces of ice are forced by air into the housing a towards the rotating blades b as indicated by a right arrow. When the ice pieces hit the rotating blade b, the impact upon the blades b break the ice pieces into smaller pieces in a crushing zone e in the housing a as indicated by a double-headed arrow. The size of the crushing zone e depends upon a relative positional relation of the inlet c with respect to the rotating blades b and the housing a. After the original ice pieces are crushed into smaller pieces, airflow pushes the crushed ice pieces towards the outlet d as indicated by a left arrow. Finally, the crushed ice pieces are outputted through the outlet d.

In the above prior art ice crushing device, there are many undesirable problems. Airflow into the inlet c must be sufficient as well as effective to cause the ice pieces to move towards the rotating blades b through the inlet c and the crushed ice pieces to move away from the rotating blades b through the outlet d. On the other hand, as airflow speed increases towards the rotational speed of the rotating blade b, since the ice pieces move more quickly in the inlet c and the rotating blades b rotate in the same general moving direction of the moving ice pieces, the impact of the ice pieces upon the rotating blades b decreases. As a result, the crushing effect or efficiency of the rotating blades b decreases.

Another undesirable characteristic of the prior art ice crushing device is a limited size of the crushing zone e. As described above, the inlet c and the outlet d form a substantially straight line and are located near the bottom of the housing a. Because of these relative locations, the crushing zone e where the rotating blades b contact with the ice pieces is rather a limited portion as indicated by the double-headed arrow. The limited crushing zone e thus generates a limited amount of crushed material and results in a low crushing efficiency.

These undesirable characteristics remain to be improved. In addition, other features are considered in the current invention for improving material crushing devices.

SUMMARY OF THE INVENTION

In order to solve the above and other problems, according to a first aspect of the current invention, there is provided a method of independently controlling a predetermined aspect of material crushing operation, including: rotating crushing blades in a covered chamber; inputting material to be crushed towards the covered chamber through at least a first inlet; crushing the material; inputting airflow into the covered chamber through at least a second inlet while the material is being crushed; independently controlling the speed, volume, temperature, and humidity of the airflow through the second inlet independent of the material input through the first inlet; and outputting the crushed material through an outlet from the covered chamber.

According to a second aspect of the current invention, there is provided an apparatus for crushing material, including: crushing blades rotatably positioned in a housing for crushing a predetermined material; at least a first inlet located on the housing for allowing the material to be deposited into the housing; at least a second inlet also located on the housing for inputting airflow into the housing at a predetermined angle while the material is being crushed; an outlet for outputting the crushed material from the housing; and a controller connected to said second inlet for independently controlling the speed, volume, temperature, and humidity of the airflow through the second inlet independent of the material input through the first inlet.

According to a third aspect of the current invention, there is provided an apparatus for crushing material, including: crushing blades rotatably positioned in a housing for crushing a predetermined material; an outlet located on the housing for outputting the crushed material from the housing; at least an inlet located on the housing near and above the outlet for allowing the material to be deposited into the housing and for inputting airflow into the housing; and a controller connected to said inlet for controlling the speed, volume, temperature, and humidity of the airflow.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
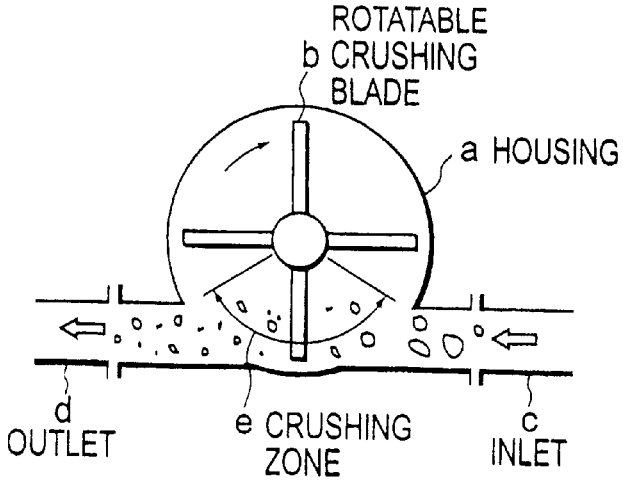
FIG. 1 PRIOR ART
FIG. 1 illustrates one exemplary ice crushing device in the prior art.
Figure 2:
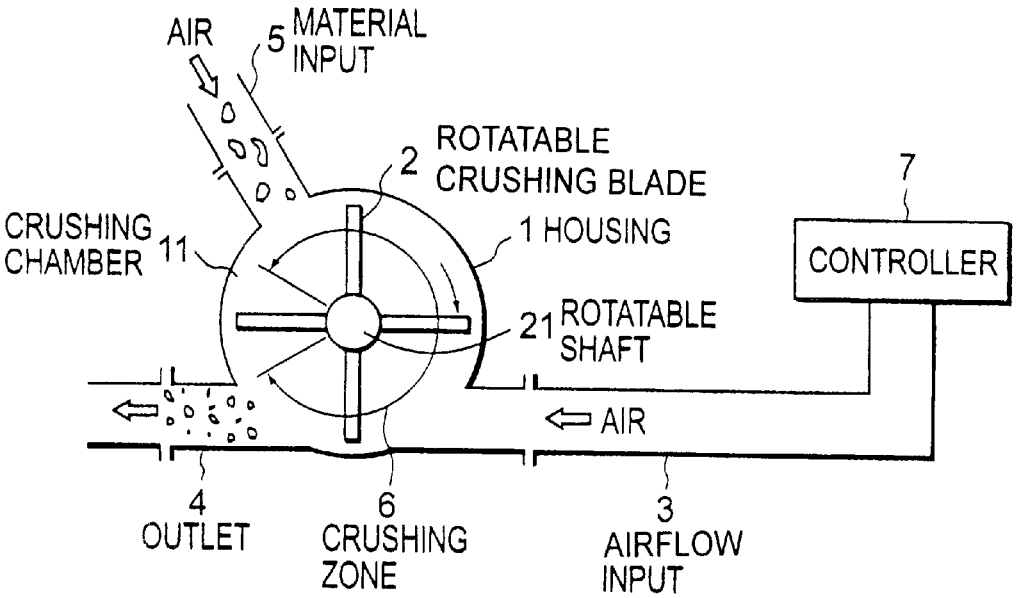
FIG. 2 is a cross sectional view illustrating a first preferred embodiment of the material crushing device according to the current invention.

Referring now to the drawings, wherein like reference numerals designate corresponding structures throughout the views, and referring in particular to FIG. 2, a first preferred embodiment of the material crushing device according to the current invention is illustrated in a cross sectional view. The first preferred embodiment includes a material input or a first inlet 5 for inputting a predetermined material such as ice into a crushing chamber 11. The crushing chamber 11 is cylindrical and is made of an appropriate material to accomplish crushing via crushing blades 2 housed therein. According to one preferred embodiment, the material to be crushed is forced by air so as to be placed into a housing 1 without being stuck inside the first inlet 5. Preferably, the first inlet 5 is positioned at a predetermined location with respect to the housing 1 so that the material falls into the crushing chamber 11 through the first inlet 5 due to gravity without forced air. Within the crushing chamber 11, a set of radiating crushing blades 2 rotate about a rotatable shaft 21 at a predetermined high speed in a clockwise direction as indicated by a solid single head arrow.

In the first preferred embodiment, the first inlet 5 is located above an outlet 4 as well as a second inlet or an airflow input 3 and is closer to the outlet 4 than to the airflow input 3. In the first preferred embodiment, the outlet 4 and the first inlet 5 form an angle that is less than ninety degrees on the left half of the housing 1. In another embodiment, the outlet 4 and the first inlet 5 are parallel with each other. Since the crushing blades 2 rotate in the clockwise direction with respect to the above described elements, the material is crushed over a wide angle of crushing zone as indicated by a double headed arrow. The crushing zone starts near the first inlet 5 where the material is first introduced in the crushing chamber 11 and is being crushed by the blades 2. The crushing zone extends over the second inlet 3 along the housing in the clockwise direction until it reaches an output area near the outlet 4. In other words, the crushing zone only excludes a smaller portion between the first inlet 5 and the outlet 4. The above described extended crushing zone increases crushing efficiency.

In the first preferred embodiment, the second inlet 3 is attached to the housing 1 at one end and a controller 7 at the other end. The controller 7 includes a compressor or an air flowing unit for independently generating airflow into the crushing chamber 11. The controller 7 controls at least the speed and volume of the airflow and optionally other aspects of the airflow. Similarly, the outlet 4 is attached to the housing 1 at a proximal end, and the cross sectional area of the outlet 4 is smaller than that of the second inlet 3 in one preferred embodiment. This difference in cross sectional area causes the airflow speed to increase in the outlet 4. The outlet 4 forms a substantially straight line with the second inlet 3 in the preferred embodiment. In another preferred embodiment, the outlet 4 and the second inlet 3 do not form a substantially straight line. The outlet 4 guides the crushed material to be outputted from the crushing chamber 11 with the help of the independent airflow from the controller 7. A distal end of the outlet 4 is aimed at a location where the crushed material is to be piled. In the alternative, the distal end of the outlet 4 is connected to the first inlet 5 for further crushing the once crushed material.

Because of the separate airflow for outputting the crushed material, the speed at which the material travels before impacting upon the rotating crushing blades 2 is independently controlled at an optimal speed. In general, assuming that the crushing blades 2 travel in a similar direction as the traveling material, the closer to the rotating speed of the crushing blades 2 the traveling velocity of the material before the impact is, the less the impact between the crushing blades 2 and the material becomes. On the other hand, the larger the difference in velocity between the traveling material and the rotating crushing blades 2 is, the more impact between the material and the crushing blades 2 results to enhance the crushing effect. In the above described preferred embodiment, the material is dropped into the crushing chamber 11 due to gravity without forced air to maximize the impact.

In one alternative embodiment, the rotating crushing blades rotate about a vertical shaft rather than a horizontal shaft. In addition, the number of crushing blades and the distance between the distal end of the blades and the inner surface of the housing are variable for a desirable purpose. These parameters generally determine efficiency for crushing material. In addition, a plurality of sets of the above described inlets 3, 5 and outlet 4 are provided along the housing 1 in an alternative embodiment.

Figure 3:
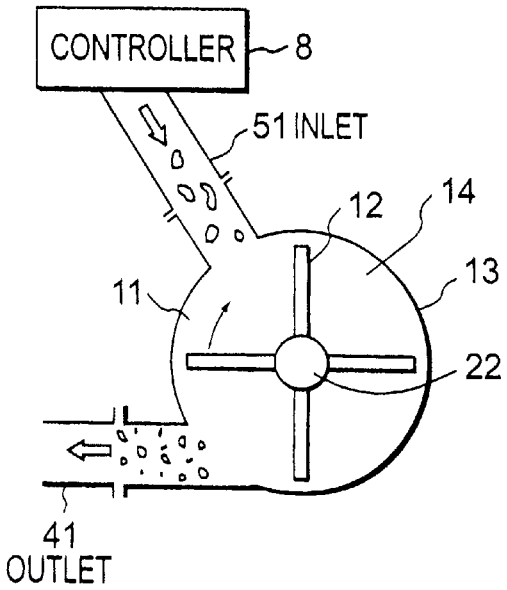
FIG. 3 is a cross sectional view illustrating a second preferred embodiment of the material crushing device, according to the current invention.

Referring to FIG. 3, a second preferred embodiment of the material crushing device according to the current invention is illustrated in a cross sectional view. The second preferred embodiment includes a material input or an inlet 51 for inputting a predetermined material such as ice into a crushing chamber 14. The crushing chamber 14 is cylindrical and is made of an appropriate material to accomplish crushing via crushing blades 12 housed therein. According to one preferred embodiment, the material to be crushed is forced by air so as to be placed into the crushing chamber 14 without being stuck inside the inlet 51. Preferably, the inlet 51 is positioned at a predetermined location with respect to a housing 13 so that the material falls into the crushing chamber 14 through the inlet 51 due to gravity without forced air. Within the crushing chamber 14, a set of radiating crushing blades 12 rotate about a rotatable shaft 22 at a predetermined high speed in a clockwise direction as indicated by a solid single head arrow. In the second preferred embodiment, the inlet 51 is attached to the housing 13 at one end and a controller 8 at the other end. The controller 8 includes a compressor or an air flowing unit for generating airflow into the crushing chamber 14. The controller 8 controls at least the speed and volume of the airflow and optionally other aspects of the airflow. The cross sectional area of the outlet 41 is smaller than that of the inlet 51 in the second preferred embodiment. This difference in cross sectional area causes the airflow speed to increase in the outlet 41. Because of the increased airflow speed in the outlet 41, the crushed material is delivered more efficiently.

In the second preferred embodiment, the inlet 51 is located above the outlet 41 and is closer to the outlet 41. In the second preferred embodiment, the outlet 41 and the inlet 51 form an angle that is less than ninety degrees on the left half of the housing 13. Since the crushing blades 12 rotate in the clockwise direction with respect to the above described elements, the material is crushed over a wide angle of crushing zone as indicated by a double headed arrow. The crushing zone starts near the inlet 51 where the material is first introduced in the crushing chamber 14 and is being crushed by the blades 12. The crushing zone extends along the housing 13 in the clockwise direction until it reaches an output area near the outlet 41. In other words, the crushing zone only excludes a smaller portion between the inlet 51 and the outlet 41. The above described extended crushing zone increases crushing efficiency.

Figure 4:
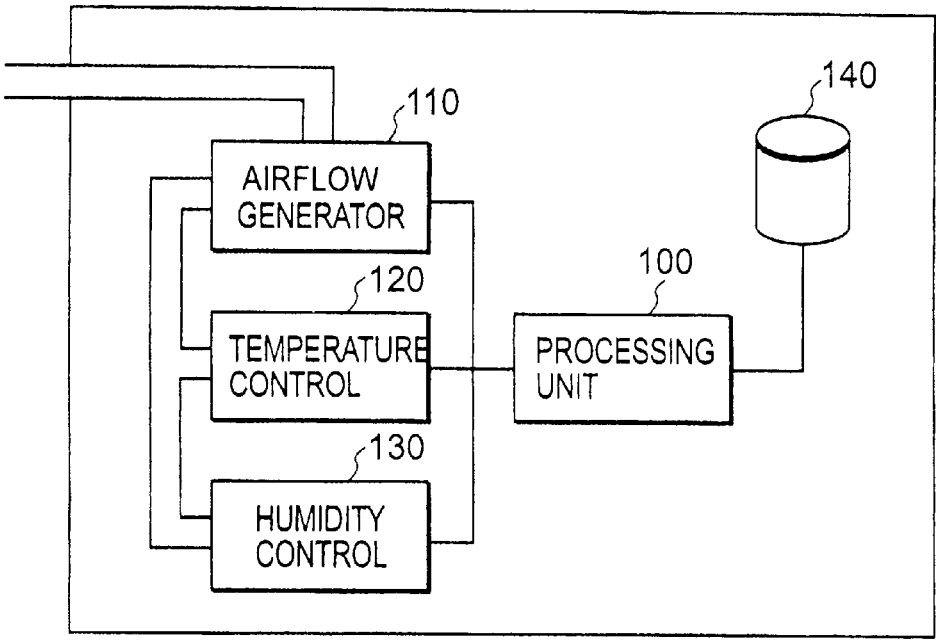
FIG. 4 is a block diagram illustrating one preferred embodiment of the control unit according to the current invention.

Referring to FIG. 4, one preferred embodiment of the controller according to the current invention is illustrated in a block diagram. The controller includes a processing unit 100 for processing information to generate a set of commands and a memory unit 140 for storing certain data to be used in generating the commands. The controller further includes an airflow generator 110 for generating airflow at a certain airflow speed and a certain air volume according to the commands from the processing unit 100. Similarly, the controller additionally includes a temperature control unit 120 and a humidity control unit 130 for respectively controlling the temperature and the humidity of the airflow according to the commands from the processing unit 100. For example, the above described control parameters may be used to generate a desirable type of snow.

Figure 5:
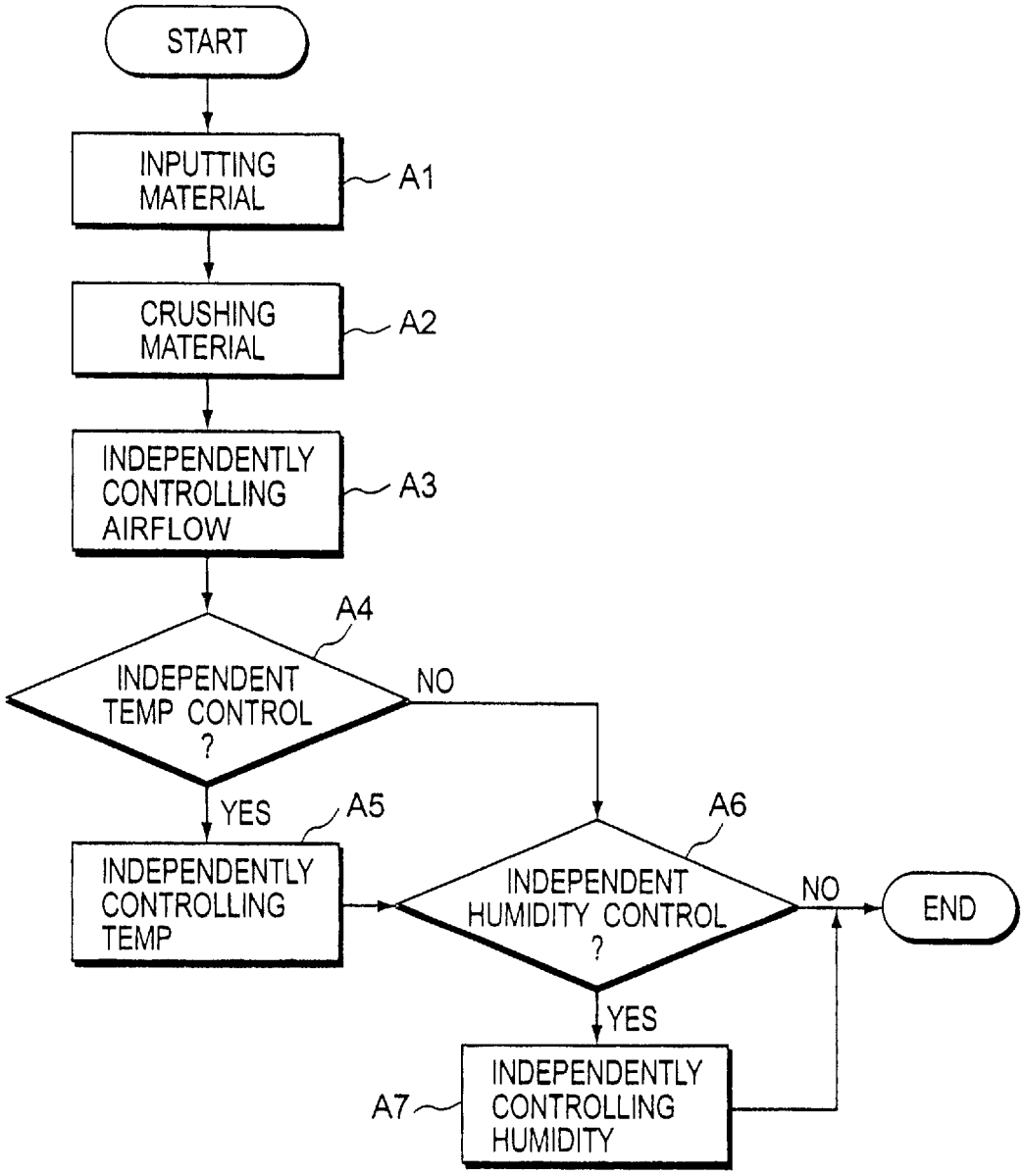
FIG. 5 is a flow chart illustrating acts involved in one preferred process of the independently generating airflow during crushing material according to the current invention.

Referring to FIG. 5, acts involved in one preferred process of independently generating airflow during crushing of material are illustrated in a flow chart. Material to be crushed is inputted into a crushing chamber through a first inlet in act A1. In one preferred process, the material is dropped into the chamber due to gravity without applying external force such as airflow. The material is crushed into finer pieces using a certain element such as crushing blades in act A2. While the material is continuously being crushed in the act A2, airflow is generated and applied into the crushing chamber to independently control the output of the crushed material from the crushing chamber in act A3. The independent airflow is separate from any other airflows that are generated in association with acts other than the act A3. In applying the independently generated airflow, in act A4, it is determined whether the temperature of the independent airflow is controlled. If the temperature is to be controlled, the temperature is adjusted to a desirable temperature in act A5. Similarly, it is determined whether the humidity of the independent airflow is controlled in act A6. If the humidity is to be controlled, the humidity is adjusted to a desirable humidity in act A7. Any combination of the above acts A5 and A7 is optionally selected before the preferred process ends.

It is to be understood, however, that even though numerous characteristics and advantages of the present invention have been set forth in the foregoing description, together with details of the structure and function of the invention, the disclosure is illustrative only, and that although changes may be made in detail, especially in matters of shape, size and arrangement of parts, as well as implementation in software, hardware, or a combination of both, the changes are within the principles of the invention to the full extent indicated by the broad general meaning of the terms in which the appended claims are expressed.

What is claimed is:

1. A method of independently controlling a predetermined aspect of material crushing operation, comprising the steps of:

rotating crushing blades in a covered chamber;

inputting material to be crushed towards the covered chamber through at least a first inlet;

crushing the material;

inputting airflow into the covered chamber through at least a second inlet while the material is being crushed;

independently controlling speed and volume of the airflow through the second inlet independent of the material input through the first inlet; and outputting the crushed material through an outlet from the covered chamber.

2. The method of independently controlling a predetermined aspect of material crushing according to claim 1, further comprising the step of independently controlling temperature of the airflow.

3. The method of independently controlling a predetermined aspect of material crushing according to claim 1, further comprising the step of independently controlling humidity of the airflow.

4. The method of independently controlling a predetermined aspect of material crushing according to claim 1 wherein a cross sectional area of the outlet is smaller than a cross sectional area of the first inlet.

5. The method of independently controlling a predetermined aspect of material crushing according to claim 1 wherein the material is dropped into the covered chamber due to gravity.

6. An apparatus for crushing material, comprising:

crushing blades rotatably positioned in a housing for crushing a predetermined material;

at least a first inlet located on the housing for allowing the material to be deposited into the housing;

at least a second inlet also located on the housing for inputting airflow into the housing at a predetermined angle while the material is being crushed;

an outlet for outputting the crushed material from the housing; and a controller connected to said second inlet for independently controlling speed and volume of the airflow through the second inlet independent of the material input through the first inlet.

7. The apparatus for crushing material according to claim 6 wherein said controller independently and additionally controls temperature of the airflow.

8. The apparatus for crushing material according to claim 6 wherein said controller independently and additionally controls humidity of the airflow.

9. The apparatus for crushing material according to claim 6 wherein a cross sectional area of said outlet is smaller than a cross sectional area of said first inlet.

10. The apparatus for crushing material according to claim 6 wherein said outlet and said second inlet form an angle substantially of 180 degrees.

11. The apparatus for crushing material according to claim 10 wherein said first inlet is located above said outlet and said second inlet, and is located closer to the outlet than to the second inlet.

12. The apparatus for crushing material according to claim 11 wherein said first inlet and said outlet form an angle of less than 90 degrees.

13. An apparatus for crushing material, comprising:

crushing blades rotatably positioned in a housing for crushing a predetermined material;

an outlet located on the housing for outputting the crushed material from the housing;

at least an inlet located on the housing near and above said outlet for allowing the material to be deposited into the housing and for inputting airflow into the housing; and a controller connected to said inlet for controlling speed and volume of the airflow.

14. The apparatus for crushing material according to claim 13 wherein said inlet and said outlet form an angle of less than 90 degrees.

15. The apparatus for crushing material according to claim 13 wherein a cross sectional area of said inlet is larger than a cross sectional area of said outlet.

16. The apparatus for crushing material according to claim 13 wherein said controller further controls temperature and humidity of the airflow.

* * * * *